US005098226A

United States Patent [19]

Venugopal

[11] Patent Number: 5,098,226

[45] Date of Patent: Mar. 24, 1992

[54] APPARATUS AND METHOD FOR DAMPING LOW FREQUENCY PERTURBATIONS OF MARINE STRUCTURES

[75] Inventor: Madan Venugopal, Clinton, Conn.

[73] Assignee: Massachusetts Institute of Technology, Cambridge, Mass.

[21] Appl. No.: 472,097

[22] Filed: Jan. 30, 1990

[51] Int. Cl.[5] ..... E02D 23/02

[52] U.S. Cl. ..... 405/205; 405/210; 405/211

[58] Field of Search ..... 405/210, 211, 212, 204, 405/205, 200, 195, DIG. 8; 114/125

[56] References Cited

U.S. PATENT DOCUMENTS

| | | | |
|---|---|---|---|
| 3,111,692 | 11/1963 | Cox | 405/DIG. 8 X |
| 3,665,721 | 5/1972 | Wyllie . | |
| 3,695,047 | 10/1972 | Pogonowski et al. . | |
| 3,779,024 | 12/1973 | Greve . | |
| 3,898,846 | 8/1975 | McCabe . | |
| 3,943,724 | 3/1976 | Banzoli et al. . | |
| 4,155,323 | 5/1979 | Finsterwalder | 114/125 X |
| 4,216,559 | 8/1980 | Switlik, Jr. | 114/125 X |
| 4,226,554 | 10/1980 | Vandiver et al. . | |
| 4,662,386 | 5/1987 | Pedersen | 405/210 X |
| 4,829,928 | 5/1989 | Bergman | 114/125 |
| 4,890,569 | 1/1990 | Givens | 114/125 X |

OTHER PUBLICATIONS

On the Nutation Damping of Fluid-Structure Interaction Instabilities and Its Application to Marine Riser Design: V. J. Modi, F. Welt and M. D. Irani; pp. 408-416.

Riser Dynamics with Internal Flow and Nutation Damping, M. B. Irani, V. J. Modi, and F. Welt, pp. 119-125.

The Dynamics of Tethered Platforms, R. C. T. Rainey, M.A., M.Sc., D.I.C., pp. 59-80.

Parasitic Motions of Offshore Structures, R. C. T. Rainey, M.A., M.Sc., D.I.C., pp. 177-194.

Cook et al., *Measured & Predicted Dynamic Response of a Single Pile Platform to Random Wave Excitation*, 1982, Offshore Technology Conference, pp. 637-646.

D'Oliviera, Offshore Structures (1980), pp. 254-270.

Mercier, *Evolution of Tension Leg Platform Technology* (1982).

Silvester, *Coastal Engineering* (1970), pp. 345-349.

Vandiver, *Effect of Liquid Storage Tanks on the Dynamic Response of Offshore Platforms*, Applied Ocean Research, vol. 1, No. 2 (1979).

*Primary Examiner*—Randolph A. Reese
*Assistant Examiner*—J. Russell McBee
*Attorney, Agent, or Firm*—Fish & Richardson

[57] ABSTRACT

An apparatus and method for dynamic absorption and damping of horizontal perturbations of a marine structure due to marine forces is disclosed. The apparatus includes an absorber tank having an internal toroidal shape, attached to the structure. The tank is to be partially filled with at least one liquid, e.g. water, and is arranged so as to be tuned to damp low frequency marine excitations, e.g. a subharmonic excitation frequency of the particular marine structure. The method includes constructing such a toroidal absorber tank, tuning the tank to the desired damping frequency, e.g. the subharmonic excitation frequency, and installing the tank on the structure. Tuning may be accomplished by varying the depth of liquid within the tank. The apparatus and method may be used on, inter alia, free-floating and tethered structures.

1 Claim, 2 Drawing Sheets

APPARATUS AND METHOD FOR DAMPING LOW FREQUENCY PERTURBATIONS OF MARINE STRUCTURES

BACKGROUND OF THE INVENTION

This invention relates to devices for damping perturbations on marine structures, and particularly devices directed to damping low frequency perturbations due to wind, water, and other marine forces.

It is known to use a partially filled tank of liquid to damp natural (fundamental) frequency oscillations of a fixed marine structure. Such a device is disclosed in Vandiver et al., U.S. Pat. No. 4,226,554, which is herein incorporated by reference. The figures of Vandiver et al. show a non-toroidal rectangular-shaped tank mounted on the structure. The tank of Vandiver et al. is used for damping oscillations in a structure fixed to a support mounted on the sea floor, as shown in FIG. 1. Such fixed structures have a high stiffness associated with their dominant modes of motion, and thus behave when oscillating like stiff springs. As such, Vandiver et al. showed that their motion dynamics can be described using linear models.

The dynamics of compliant (i.e., free floating or tethered) structures are somewhat different. Compliant structures have low stiffness associated with their motions in the horizontal plane, and thus behave more like soft springs. As such, a linear model of behavior in the case of compliant structures would ignore important non-linear effects. For example, in compliant structures, there is a significant non-linear coupling between vertical (or heave) and horizontal (or sway) excitations on the structure due to, e.g., wind, wave action, or underwater seismic disturbances. This coupling leads to a time-dependent stiffness term in the motion equation for the horizontal plane. The mathematical model for motions in the horizontal plane is thoroughly described in R. Rainey, "Parasitic Motions of Offshore Structures," Transactions of the Royal Institutions of Naval Architects 177 (1982), which is herein incorporated by reference. The model resembles the Mathieu equation, the solutions of which show responses at frequencies lower than the natural (of fundamental) frequency of the structure. These frequencies are known as subharmonic resonances, and are very difficult to design against. Most marine structures are dynamically designed so that their natural frequencies are outside the range of the excitation frequencies of the sea. However, such designs do not correct for subharmonic resonances. In the open ocean, particularly in very deep waters (i.e., for a structure the size of an offshore platform, depths of greater than 2500 ft.), there exist swells and other low frequency excitations over and above the dominant natural wave frequency. In addition, there exist drift forces due to group waves which create very low frequency excitations in the horizontal plane in compliant structures. In free-floating structures, these forces can cause undesirable shifts in position. In tethered structures, these forces can cause dynamic stressing and fatigue of the tethers.

SUMMARY OF THE INVENTION

In general the invention features correcting for these marine forces in compliant structures by installing a toroidally-shaped hydrodynamic absorber onto such structures. The invention provides dynamic absorption and damping of horizontal perturbations of a marine structure due to marine forces.

In preferred embodiments, the apparatus includes an absorber tank attached to the structure, having an internal toroidal shape. The tank is partially filled with at least one liquid. The tank's arrangement is such that it is tuned to low frequency marine excitations, e.g. a subharmonic excitation frequency of the structure. The structure may be located in deep water. The absorber tank may be attached to the structure at a location above the waterline, and may form the platform of the structure. The toroidal shape of the interior of the tank may have a circular, elliptical, or rectangular axial cross section, or any shape in between, such as a hexagon. In preferred embodiments the structure itself may be free-floating or tethered to a support structure mounted on the sea floor. Tuning is performed by varying the depth of said at least one liquid in said tank until a desired tank damping frequency is attained.

Advantages of the invention includes its ability to damp low-frequency subharmonic resonances that affect virtually any marine structure, e.g. deep-water marine platforms, tethered buoyant platforms, tension leg platforms, guyed towers, drillships, semisubmersibles, jackup platforms, floating breakwaters, and buoys. The toroidal absorber tank can be used to suppress any low frequency motion, e.g. wind and wave induced forces, seismic disturbances, responses due to impacts from artificial objects such as boats or ship, or from natural object such as icebergs. Further, it is omnidirectional and inexpensive to construct and install. The absorber can be designed into a new structure or retrofitted to an existing structure. The tank's weight is generally low, since the optimal liquid level for most structures is very low. The tank has a broad frequency band of effectiveness, and, if the natural frequency of the structure is near an integer multiple of the subharmonic to which the tank is tuned, the natural frequency of the structure is damped along with the subharmonic. Additionally, the absorber tank may be tuned to damp the horizontal perturbations on the structure caused by vertical (heave) motion.

Other features and advantages of the invention will become apparent from the following description of the preferred embodiment, and from the claims.

DESCRIPTION OF THE PREFERRED EMBODIMENT

FIG. 1 is a perspective, somewhat diagrammatic, view of a rectangular cross sectional embodiment of the toroidal absorber tank of the invention;

FIGS. 2A, 2B, and 2C are cross sectional views taken through three different tanks of the invention;

Figure 1:
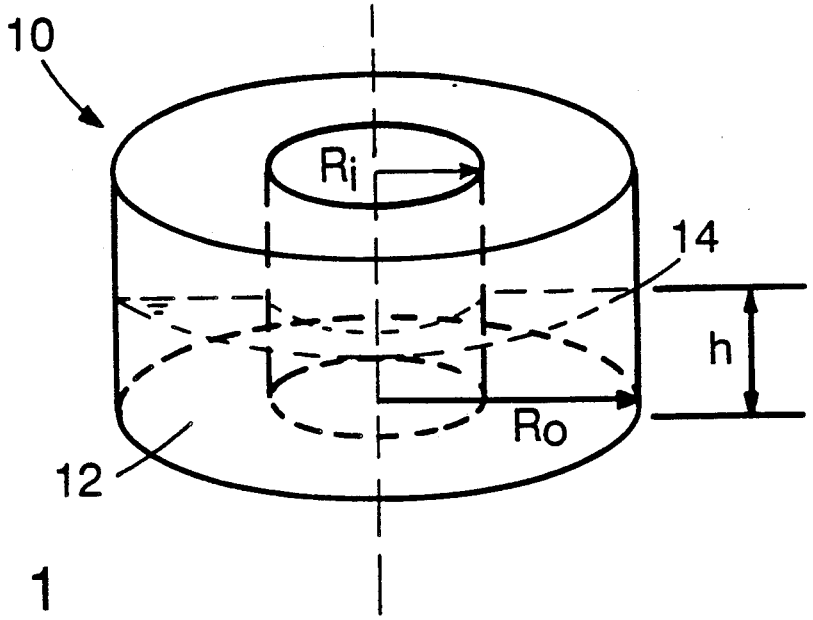

Designing the dynamic absorber of the invention involves choosing the dimensions of the toroid and depth of fluid in it to generate a fundamental natural frequency of fluid motion in the tank that is very close to the frequency of the structural perturbations to be damped.

When a toroid partially filled with fluid oscillates transversely, the fluid within it moves transversely and circumferentially. The fluid motion within the toroid can be modelled using linear, potential flow theory. This involves solving Laplace's equation for the velocity potential function with the appropriate wall and free surface boundary conditions. Near resonance, the fluid motion is highly nonlinear. Further, the effects of viscosity may not be negligible. However, in the design of an absorber for a practical application, the size of the absorber can be decided using a linearized analysis and the correct amount of fluid determined by trial on installation of the absorber.

The analysis for an absorber with a rectangular cross-section provides an eigenvalue equation for the motion of the fluid as, $$Y_1'(\lambda_{1i})\, J_1'(\lambda_{1i} R_i/R_o) - J_1'(\lambda_{1i})\, Y_1'(\lambda_{1i} R_i/R_o) = 0 \qquad (1)$$

where $\lambda_{1i}$ = Eigenvalue for the ith transverse mode with the first circumferential mode.

R = Inner radius of torus.

R = Outer radius of torus.

$J_1$, $Y_1$ = Bessel functions of first and second kind of order 1 respectively.

Primes indicate derivatives with respect to the radial coordinate, r. The eigenvalue $\lambda_{1i}$ physically represents a non-dimensional wavelength of the circumferential fluid motion.

The dispersion relation between the frequency of the fluid motion and its wavelength is, $$\omega_{1i}^2 = \frac{\lambda_{1i} g}{R_o} \tanh(\lambda_{1i} h/R_o) \qquad (2)$$

where, $\omega_{1i}$ = Natural Frequency of fluid in ith mode;

h = Depth of fluid in toroid; and g = Acceleration due to gravity.

The volume of fluid in the toroid with a rectangular cross-section is given by, $$\text{Volume, } V = \pi\,(R_o^2 - R_i^2)\, h \qquad (3)$$

For use as a dynamic absorber, the natural frequency of the fluid in the toroid is tuned to be the same as the frequency of transverse oscillation of the structure. Hence the design problem is to decide the geometry of the toroid given the frequency of the transverse oscillation. Taking the first circumferential mode of oscillation of the fluid to be the most significant, for a specified volume of fluid, natural frequency of oscillation and outer radius of the toroid, solving equations (1), (2) and (3) simultaneously will yield an inner radius of the toroid and fluid depth.

It is noted that equations (1), (2) and (3) represent a set of nonlinear simultaneous equations. The eigenvalue equation has multiple roots of which we want the first root. Hence, care must be exercised in choosing a method of solution.

Figure 2A:
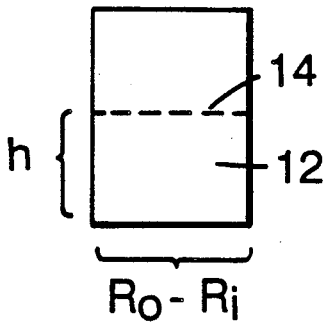
Figure 2B:
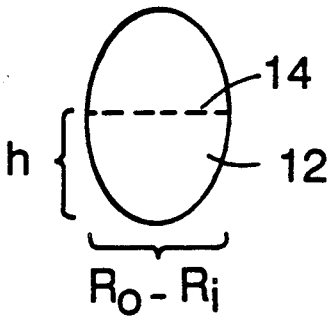
Figure 2C:
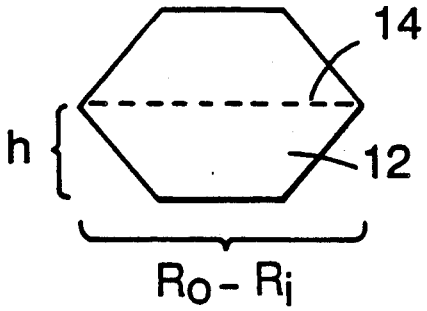

Referring to FIG. 1, the toroidal absorber tank 10 of the invention is shown, having a rectangular axial cross section (FIG. 2A). The tank 10 has an inner radius $R_i$ and an outer radius $R_o$, and is preferably constructed of polyvinyl chloride. Alternatively, the tank may be fabricated from aluminum or stainless steel coated with an anticorrosive paint, from fiberglass, or from composite materials. The tank is partially filled with at least one liquid 12, e.g. water, leaving an open surface 14 within the tank (indicated by dashed line). The height of the water h determines the damping frequency of the tank 10. Hence, one method of tuning the tank 10 to a desired damping frequency is to vary the liquid height h until the desired frequency is achieved FIG. 2B demonstrates an embodiment of the invention, wherein the tank has a roughly circular or elliptical cross section. FIG. 2C demonstrates an embodiment having a hexagonal cross section.

Figure 3:
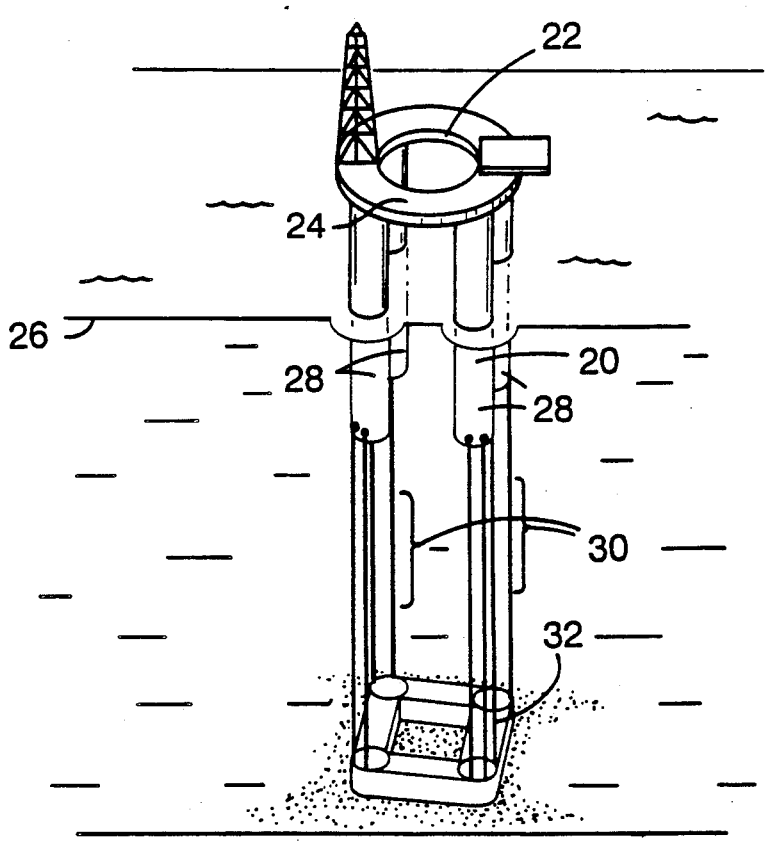
FIG. 3 is a perspective view of the invention incorporated into a tethered marine structure.

FIG. 3 illustrates a tethered platform structure 20 embodying the invention. The tank 22 is incorporated into the structure 20 for use as a platform 24. The tank 22 is positioned to be well above the waterline 26, by means of floating supports 28. Tethers 30 attach the structure 20 to a support structure 32 mounted on the sea floor.

Figure 4:
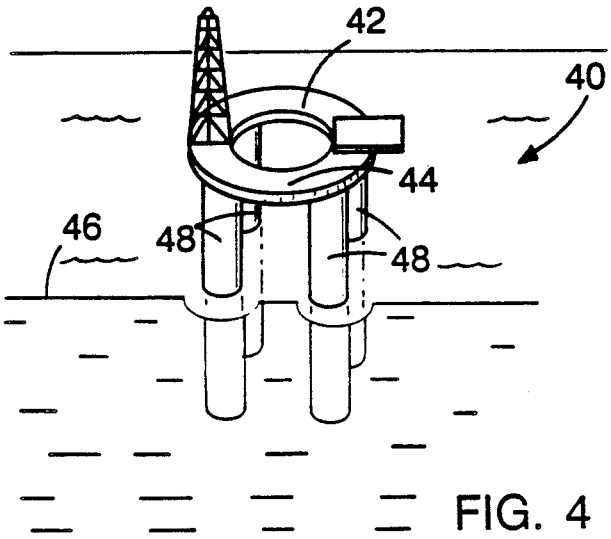
FIG. 4 is a perspective view of the invention incorporated into a freely floating marine structure.

FIG. 4 illustrates the invention in the context of a freely floating platform structure 40. The tank 42 is incorporated into the structure 40 for use as a platform 44. The tank 42 is positioned to be well above the waterline 46 by means of floating supports 48.

Figure 5:
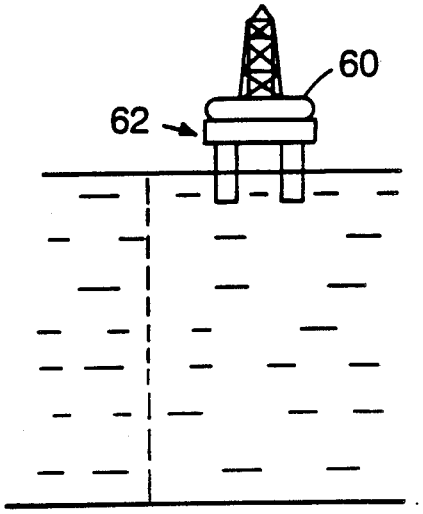
FIG. 5 is a perspective view of the invention as installed on a freely floating marine structure.

Other embodiments are within the following claims. For example, the absorber tank may have other axial cross sections, e.g. octagonal, parabolic, hyperbolic, or triangular so long as the general toroidal shape is maintained. Also, the toroidal tank of the invention may be retrofitted to an existing structure (such as a buoy) or simply placed upon a structure but not used as the platform. Such are demonstrated in FIG. 5, wherein the tank 60 is installed on the structure 62. The structure 62 in FIG. 5 is shown freely floating, but the concept applies equally to tethered structures. Further, the tank of the invention may be installed on any other type of marine structure, such as tethered buoyant platforms, tension leg platforms, guyed towers, drillships, semisubmersibles, jackup platforms, or buoys.

What is claimed is:

1. A method of dynamic absorption and damping of horizontal perturbations of a floating marine structure tethered in very deep water, said method comprising the steps of:

providing an absorber tank fixed to said structure at a location above the waterline, said tank having an internal volume in the shape of a toroid, said toroid having a central axis, and said tank being fixed in such an orientation that said axis is substantially vertical;

determining at least one subharmonic resonant frequency of said floating marine structure, said frequency being below the lowest harmonic frequency of said structure and within the range of wave excitation on said structure;

filling said tank at least partially full with at least one liquid; and selecting the height of liquid in said tank so that said tank is tuned to said subharmonic resonant frequency.

* * * * *